United States Patent [19]

Satoh et al.

[11] 4,330,036

[45] May 18, 1982

[54] CONSTRUCTION OF A HEAT TRANSFER WALL AND HEAT TRANSFER PIPE AND METHOD OF PRODUCING HEAT TRANSFER PIPE

[75] Inventors: Yoshiyuki Satoh, Isehara; Tomio Higo, Hatano, both of Japan

[73] Assignee: Kobe Steel, Ltd., Kobe, Japan

[21] Appl. No.: 180,038

[22] Filed: Aug. 21, 1980

[51] Int. Cl.[3] ..... F28F 1/42

[52] U.S. Cl. ..... 165/179; 165/184

[58] Field of Search ..... 165/179, 184

[56] References Cited

U.S. PATENT DOCUMENTS

| | | | |
|---|---|---|---|
| 2,244,800 | 6/1941 | Pascale | 165/179 |
| 3,217,799 | 11/1965 | Rodgers | 165/179 |
| 3,255,516 | 6/1966 | Sommer | 165/179 X |
| 3,295,599 | 1/1967 | Okamoto et al. | 165/184 |
| 3,481,394 | 12/1969 | Withers, Jr. | 165/179 |
| 3,768,291 | 10/1973 | Rieger | 165/179 X |
| 3,779,312 | 12/1973 | Withers, Jr. et al. | 165/179 X |
| 3,847,212 | 11/1974 | Withers, Jr. et al. | 165/179 |
| 3,902,552 | 9/1975 | McLain | 165/179 |
| 4,059,147 | 11/1977 | Thorne | 165/179 X |
| 4,161,214 | 7/1979 | Wendel | 165/179 X |

FOREIGN PATENT DOCUMENTS

| | | | |
|---|---|---|---|
| 177068 | 12/1953 | Austria | 165/179 |
| 264076 | 8/1968 | Austria | 165/179 |
| 643979 | 7/1962 | Canada | 165/179 |
| 565027 | 10/1944 | United Kingdom | 165/179 |
| 996211 | 6/1965 | United Kingdom | 165/181 R |

*Primary Examiner*—Sheldon J. Richter

*Attorney, Agent, or Firm*—Oblon, Fisher, Spivak, McClelland & Maier

[57] ABSTRACT

A heat transfer wall comprises a heat transfer wall body, a number of fins integrally formed on one surface of the body, extending parallel to each other and having breaks formed therein at predetermined intervals, and a number of beads integrally formed on the other surface of the body. This arrangement may be applied to a heat transfer pipe. Thus, the pipe comprises a heat transfer pipe body, at least one row of spiral fins integrally formed on the outer surface of the body and having breaks formed therein at predetermined intervals, and a number of beads integrally formed on the inner surface of the body. A method of producing such heat transfer pipes comprises the steps of rolling the outer surface of a pipe to form spiral fins integral with the pipe wall, and urging a sharp edged rolling tool against the outer surface of the pipe while rotating the tool on the outer surface of the pipe along a spiral path having a lead angle which is in reverse relation to the lead angle of the fins so as to form breaks in the fins at predetermined intervals while inwardly bulging the inner surface of the pipe at the positions corresponding to the breaks to form beads on the inner surface of the pipe at these positions.

4 Claims, 10 Drawing Figures

CONSTRUCTION OF A HEAT TRANSFER WALL AND HEAT TRANSFER PIPE AND METHOD OF PRODUCING HEAT TRANSFER PIPE

BACKGROUND OF THE INVENTION

1. Field of the Invention

The present invention relates to constructions of a heat transfer wall and heat transfer pipe which maximize the effeciency of heat exchange, and a method of producing such a heat transfer pipe.

2. Description of the Prior Art

The effeciency of heat exchange of refrigerant condensers and the like used in refrigerators, coolers and the like depends on the performance of the heat exchange walls employed, namely the heat transfer walls, and in order to increase the performance of heat exchangers or to make them compact, it is essential to improve the performance of the heat transfer walls. For this reason, studies have heretofore been conducted on the materials and construction of heat transfer walls (especially, heat transfer pipes) to increase their efficiency and some of the results of these studies have been put into practical use. The basic construction of heat transfer walls now in use comprises a number of fins formed on the surface of a wall on the refrigerant side to increase the effective area of heat exchange, such arrangements achieving some results. With such an arrangement alone, however, it is impossible to follow the current trend toward small size and light-weight. Accordingly, there have been proposed improved techniques, including those disclosed in Japanese Patent Disclosure No. 868555/1976, Japanese Patent Publication No. 11670/1977 and Japanese Utility Model Disclosure No. 128349/1976, but they are still insufficient to meet the requirement of light-weight.

SUMMARY OF THE INVENTION

We have conducted intensive research to further increase the heat transfer efficiency of heat transfer walls and found that said efficiency can be substantially increased by (1) further increasing the effective area of heat transfer, (2) preventing liquid films from adhering to the surface of contact with the refrigerant and (3) disturbing the flow of liquid on the cooling liquid side.

With these findings in mind, we have developed a heat transfer wall capable of meeting all of the requirements described above. The basic arrangement thereof comprises (1) a heat transfer wall body, (2) a number of fins integrally formed on one surface of said body, extending parallel to each other and having breaks therein with a predetermined pitch, and (3) a number of beads integrally formed in independently projecting relation on the other surface of said body. This heat transfer wall exhibits superior performance when used as a heat exchanger plate or a heat exchanger pipe. The fins with breaks, as compared with longitudinally continuous fins, increase the effective area of heat transfer by an amount corresponding to the cross-sectional areas of said breaks. Further, the break portions separate the grooves between the fins from each other. Accordingly, residence of refrigerant condensate and adhesion of liquid films are prevented, thereby greatly increasing the efficiency of heat transfer on the refrigerant side. The beads formed on the side opposite to the fins function to disturb the flow of cooling liquid, thereby increasing the efficiency of heat transfer on the cooling liquid side. In this case, if the heat transfer wall surface on the cooling liquid side is made in a wavy form, this, coupled with said beads, will further disturb the flow of cooling liquid to further increase the efficiency of heat transfer.

Another feature of the present invention lies in a method for producing a pipe with said heat transfer wall in a simple operation. This method comprises the steps of (1) rolling the outer surface of a pipe to form spiral fins integral with the pipe wall, and (2) urging a sharp edged tool against the outer surface of the pipe while rotating said tool on the outer surface of the pipe along a spiral path having a lead angle which is in reverse relation to the lead angle of said fins, so as to form breaks in the fins at predetermined intervals and at the same time inwardly bulge the inner surface of the pipe at positions corresponding to said breaks to thereby form the projecting beads. As an alternative to step (2), a sharp edged tool may be rotated on the outer surface of the pipe along a spiral path having a lead angle of the same direction as, but greater than, the lead angle of the fins, to form projecting beads on the inner surface of the pipe. Further, by adjusting the urging pressure on the sharp edged tool, it is possible to form the projecting beads on the inner surface of the pipe in the form of repeated continuous waves over the entire inner surface of the pipe.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein:

FIG. 1 is a sketch of a portion of the wall, and FIGS. 2(A), 2(B) and 2(C) show, in developed views, the respective back end and front surfaces of the wall;

FIG. 3 is a fragmentary side view, and FIG. 4 is a fragmentary sketch;

DETAILED DESCRIPTION OF THE PREFERRED EMBODIMENTS

The arrangement, functions and effects of the invention will now be described with reference to the drawings showing embodiments of the invention. The following illustrates the most typical examples, but it is to be understood that these are not intended to limit the scope of the invention and that changes and modifications thereof are within the technical scope of the invention.

Figure 1:
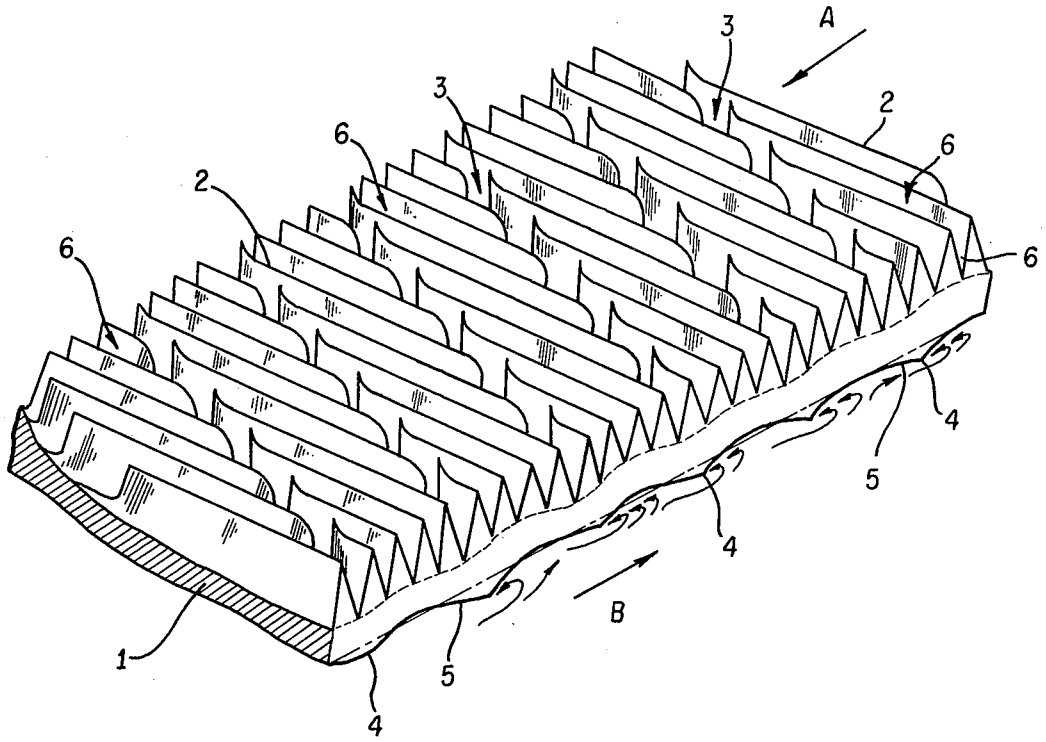
FIGS. 1, 2(A), 2(B) and 2(C) show by way of example a heat transfer wall according to the present invention.
Figure 2C:
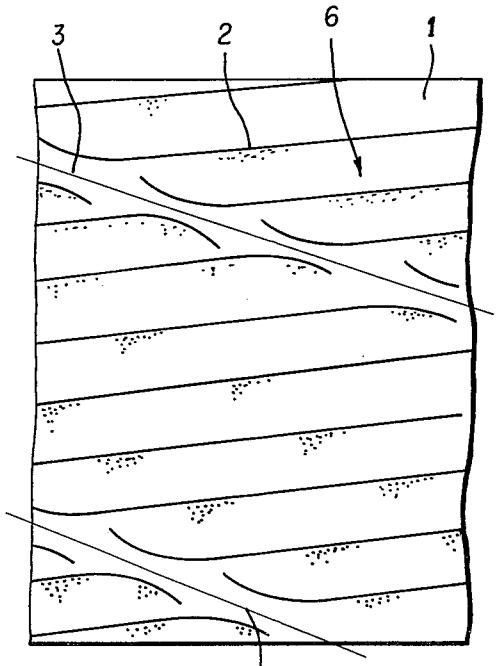
Figure 2B:
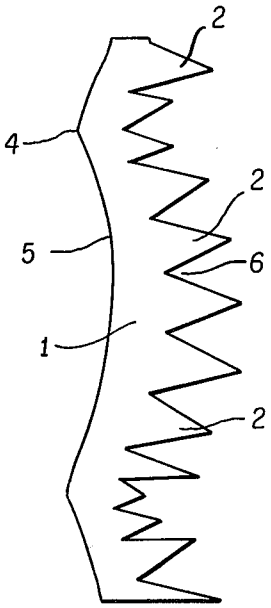
Figure 2A:
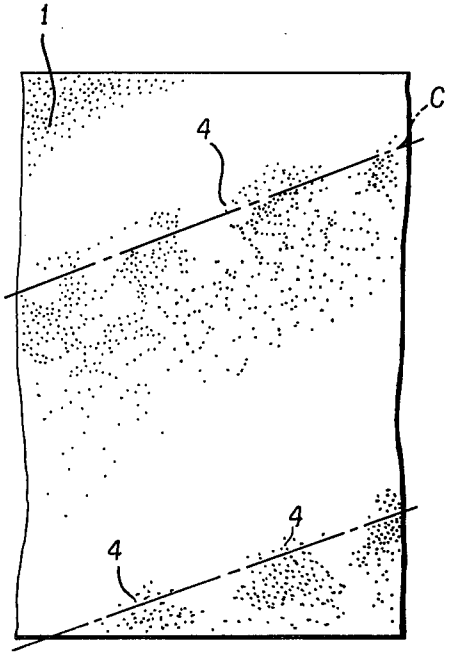

FIGS. 1, 2(A), 2(B) and 2(C) show by way of example the arrangement of a heat transfer wall according to the invention. FIG. 1 is a fragmentary sketch and FIGS. 2(A), 2(B) and 2(C) show, in developed views, the back, end surface and front of the wall; FIG. 2(A) shows the back, FIG. 2(B) shows the end surface, and FIG. 2 (C) shows the front. A heat transfer wall body 1 has a number of fins 2 integrally formed on the front surface thereof, extending parallel to each other and having breaks 3 formed therein with a predetermined pitch. The back of the wall body 1 has a number of projecting beads 4, so that said back has repeated continuous waves 5 defined by said beads and the resulting bulges therearound.

In performing heat exchange by using this wall, a medium to be cooled is passed along the front side of the wall in the direction of arrow A while a cooling medium is passed along the back side in the direction of arrow B. Since the fins 2 on the front increase the surface area and the breaks 3 formed at predetermined intervals further increase the surface area, the efficiency of contact between the refrigerant and the wall is very high. If the fins 2 were formed in a plurality of continuous rows, there would be a danger that the condenstate of refrigerant which forms during heat exchange would reside in grooves 6 between the fins to form liquid films which substantially decrease the efficiency of heat transfer. In the present invention, however, the grooves 6 are cut into sections by the breaks 3 and adjacent grooves 6 are continuous with each other through the associated breaks 3, so that formation of liquid films is greatly suppressed. Even if a small amount of condensate collects in the grooves 6, it will soon progressively flow along the breaks 3 to the downstream side where it is removed. Therefore, formation of liquid films of condensate or a decrease of the efficiency of heat transfer due to residence of such films can be prevented.

On the other hand, the beads 4 and waves 5 formed on the back of the wall body 1 develop a superior heat transfer effect by disturbing the flow of cooling liquid while increasing the area of contact with said cooling liquid. More particularly, in order to increase the rate of heat transfer from the heat transfer wall 1 to the cooling liquid, it is very effective to bring the cooling liquid, in a turbulent state, into contact with the heat transfer wall 1. The beads 4 or the same in combination with the waves 5 act to cause the back of the wall to produce turbulence.

The heat transfer wall of the present invention has the basic construction outlined above. Thus, fins 2 with breaks 3 and beads 4 (and waves 5) are integrally formed on the front and back, respectively. In practical use, for the sake of convenience of formation, it is preferable to establish a relation between the positions of the breaks 3 and beads 4. For example, in producing a heat transfer wall according to the invention, the easiest method would be to form a number of parallel fins on the surface of a plate blank as by forging, and then move a sharp edged rolling tool in a direction which crosses the direction of formation of the fins while urging said tool against the surface so as to form breaks 3 in the continuous fins at predetermined intervals. At positions where breaks 3 are formed, the fins are cut and crushed, with the excess metal material acting through the wall body to cause the back to bulge to form beads 4. By adjusting the urging pressure, peripheral portions around the beads 4 may be caused to bulge or deform to form waves 5 on the back surface. Therefore, in cases where such method of formation is employed, it is easiest to provide an arrangement wherein, when the wall surface of the wall body 1 is seen in a direction perpendicular thereto, imaginary lines C connecting the beads 4 (FIG. 2(A)) cross the direction of the formation of the fins 2, and it is most common to provide an arrangement wherein the beads 4 are formed at all (or some) of the intersections between the imaginary lines C and fins 2 (namely, the regions of the back corresponding to the breaks 3). Further, in this process, by adjusting the urging pressure on the rolling tool or the like, peripheral regions around the beads 4 may suitably bulge to form repeated continuous waves 5 on the back with the imaginary lines C defining their edges.

The foregoing only exemplifies the positional relation between advantageous fins 2, breaks 3, beads 4 and waves 5 in connection with a method of production, and if other methods are employed, it is possible to establish other positional relations than the one described above or to form fins 2 and breaks 3 on the front independently of beads 4 and waves 5 on the back, such a heat transfer wall being, of course, included in the technical scope of the invention.

In addition to the example shown in FIGS. 1 and 2, suitable changes in the shape and spacing of the fins 2, in the size and spacing of the breaks 3 and the beads 4 and in the waveform and pitch of the waves 5 are possible and included in the technical scope of the invention.

The above description refers to a planar form of heat transfer wall taken as an example, but if the heat transfer wall of the invention is utilized, it is possible to place a number of plates one upon another to provide a multilayer heat transfer unit or a thin-walled box-like heat transfer unit. However, the most practical way would be to use it as a heat transfer pipe. Therefore, description will be given of an example in which the invention is applied to a heat transfer pipe.

Figure 3:
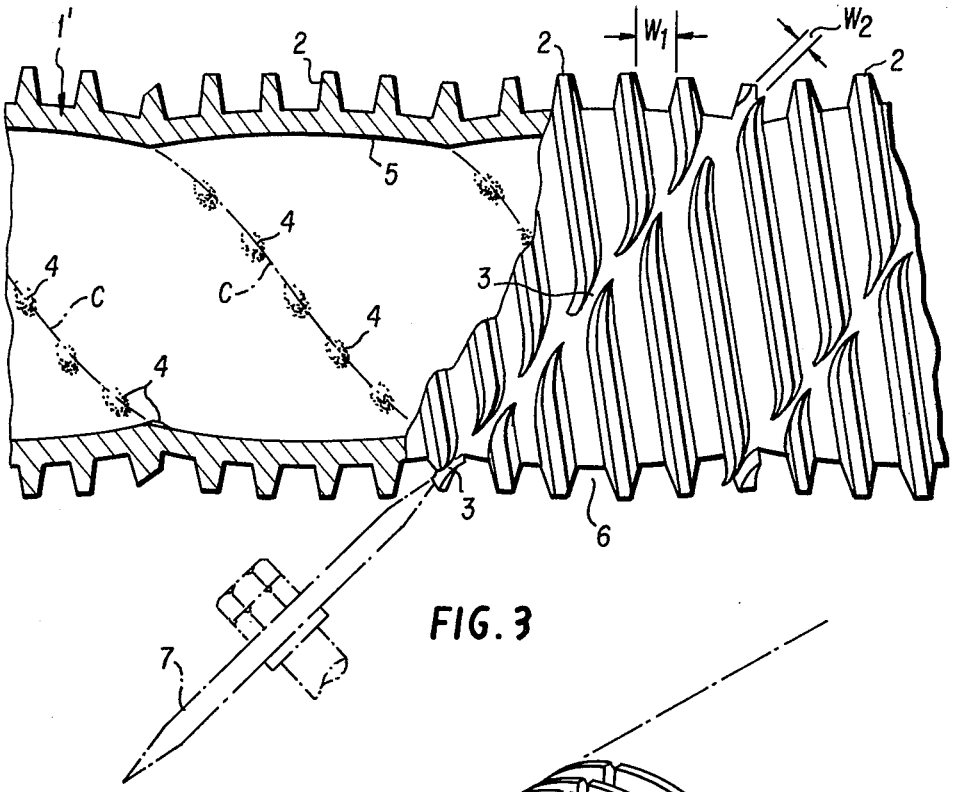
FIGS. 3 and 4 show by way of example a heat transfer pipe according to the invention.

FIG. 3 is a side view, in section, of a principal portion exemplifying a heat transfer pipe according to the invention. The outer surface of a heat transfer body 1′ is integrally formed with a row (or two or more rows) of spiral fins 2 having breaks 3 with a predetermined pitch, while the inner surface of the body 1′ is integrally formed with a number of beads 4. If this heat transfer pipe is axially sectioned, as shown in FIG. 3, it is seen that the beads 4 and the peripheral regions therearound bulge as if squeezed on the inner surface of the pipe and repeated continuous waves 5 are formed on the inner surface of the pipe. In using this heat transfer pipe, a medium to be cooled and a cooling liquid are passed over the outer and inner surfaces of the pipe, respectively, for heat exchange. As in the case of the embodiment described with reference to FIGS. 1, 2(A), 2(B) and 2(C), the heat transfer function, the condensate film formation and residence preventing function of the spiral fins 2 with breaks 3 formed on the outer surface of the pipe, and the turbulence promoting function of the beads 4 and waves 5 formed on the inner surface of the pipe provide a maximum of heat transfer efficiency.

The spiral fins 2 to be formed on the outer surface of the heat transfer pipe body 1′ can be simply formed by the usual rolling process and may be provided in a single row or two or more rows extending parallel to each other. The pitch can be changed as desired by adjusting the lead angle of the rolling tool and this may be suitably set in accordance with the intended efficiency of heat transfer. Further, in the invention, breaks 3 are formed in the fins at predetermined intervals to establish the communication between the grooves 6 defined between adjacent fins, thereby further increasing the effective contact area of the fins 2 and preventing formation of films of condensate and residence thereof, these effects being further promoted by decreasing the spacing between the breaks 3.

The beads 4 to be formed on the inner surface of the pipe may be formed at random, but if the following method of production is considered, the most common arrangement of the beads 4 would be such that they are regularly formed with a predetermined pitch on imaginary lines C which are parallel to each other.

Figure 4:
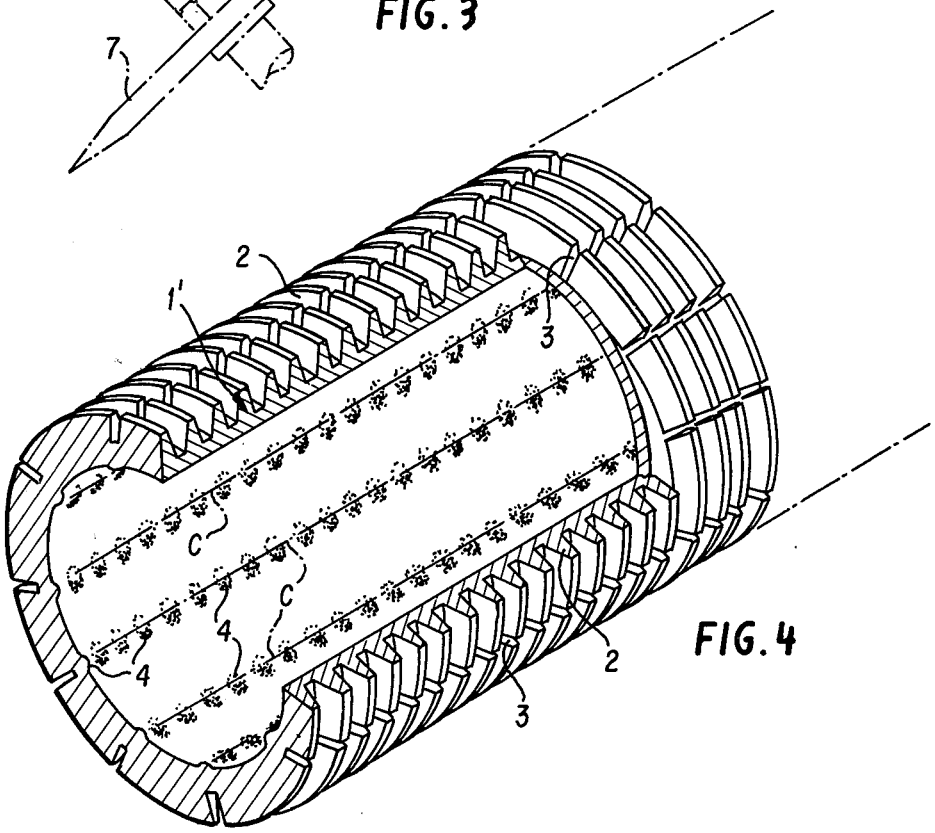

The heat transfer pipe of the invention is produced by rolling the outer surface of a tubular blank to form spiral fins 2 and then urging a sharp edged rotary tool 7 against the outer surface of the pipe, shown in FIG. 3, while rolling the tool in a direction which crosses the fins 2 while rotating the pipe, thereby crushing while cutting the fins 2 with a predetermined pitch to form breaks 3. As described with reference to FIGS. 2(A), 2(B) and 2(C), the excess pipe wall material crushed at the breaks 3 bulges to form beads 4 on the inner surface of the pipe while axially squeezing the pipe to form repeated continuous waves 5 on the inner surface of the pipe. According to this method, it is possible to form beads 4 and waves 5 concurrently with breaks 3, with the beads 4 formed on the inner surface directly opposite to the breaks 3, so that the spacing of the breaks 3 necessarily coincides with the spacing of the beads 4. Therefore, by adjusting the direction of rolling of the rotary tool for forming breaks 3, it is possible for the imaginary lines C connecting the beads 4 to assume a spiral form (FIG. 3) or if the rotary tool 7 is rolled axially of the pipe, as shown in FIG. 4 it is possible to form breaks 3 and beads 4 along imaginary lines C which are parallel to the axis of the pipe. In some cases, the rotary tool 7 may be rolled circumferentially of the pipe to form breaks 3 and beads 4 along circumferential imaginary lines C.

In the example shown in FIG. 3, the lead angle of the fins 2 is directed in reverse relation to the lead angle of the imaginary lines. As is clear from the foregoing description, the direction of arrangement of the breaks 3 defines the imaginary lines C connecting the beads 4 and the breaks 3 are formed at the intersections between the path of rolling of the rotary tool 7 and the fins 2. Therefore, so long as the imaginary lines C and the fins 2 cross each other, the lead angles of the two can be suitably changed. Therefore, in addition to the example shown in FIG. 3, an arrangement wherein the lead angle of the fins 2 and the lead angle of the imaginary lines C have the same direction and the latter is greater than the former, can, of course, enjoy the effects of the invention.

Further, the waves 5 on the inner surface of the heat transfer pipe are formed not only by the beads 4 and the peripheral regions thereabout bulging out but also by the circumferential pressure from the rotary tool 7 circumferentially squeezing the material. These actions result in undulations having a definite wavelength in the direction of the pipe axis, thus forming waves 5. The size of the waves 5 can be adjusted as desired by adjusting the pressure on the rotary tool. Thus, by controlling said pressure with consideration given to pressure loss on the inner surface, the turbulence promoting effect may be increased.

In addition, in the heat transfer pipe of the present invention, it is desirable that the spacing $W_1$ between the fins 2 and the width $W_2$ of the breaks 3 be in the relation $W_1 > W_2$. In the present invention, since the breaks 3 are formed by crushing the fins 2 rather than by cutting or shearing the same, $W_1 < W_2$ would decrease the effective area of the outer surface, failing to suit the invention.

Since the heat transfer pipe of the invention is produced by plastically deforming the fins 2 by the rotary tool 7, as described above, it is required that the fins 2 (and the pipe body) have a suitable degree of plastic processability. If the fins 2 are too hard or brittle, formation of the breaks 3 and projections 4 becomes impossible or the fins 3 can be damaged during processing. In such a case, therefore, it is desired to subject the finned pipe to heat treatment to increase its plastic processability prior to the main processing. On the other hand, if the pipe body is too soft, it can collapse or bend during the main processing. In such case, therefore, the main processing may be preceded by work hardening by a preparatory treatment, such as heat treatment or machine work.

The present invention is embodied substantially in the manner described above and is very useful, the effects thereof being summarized as follows:

(1) By forming breaks in longitudinally continuous fins at predetermined intervals, the surface area of the fins themselves, namely, the effective area of heat transfer can be increased by about 5–20%. Moreover, formation of breaks in fins prevents formation and residence of films of condensate. These effects combined greatly increase the efficiency of heat transfer on the refrigerant side.

(2) Formation of a large number of beads possibly with waves on the surface of the cooling liquid side disturbs the cooling liquid, so that it is possible to achieve a sufficient rate of heat transfer on the cooling liquid side without having to substantially increase the rate of flow.

(3) According to the method of producing heat transfer pipes of the present invention, a pipe formed with spiral fins in the usual manner can be formed with beads and waves concurrently with the formation of breaks on the inner surface. Thus, the forming operation is very simple. Moreover, the pitch and shape of spiral fins can be changed as desired by adjusting the shape of the rolling tool and the lead angle, while the size and pitch of breaks and the size and pitch of beads and waves can be adjusted as desired by controlling the shape of the tool and the lead angle and pressure. Thus, heat transfer pipes which meet particular objects can be easily produced.

An example of the invention is given below.

EXAMPLE 1

Figure 5:
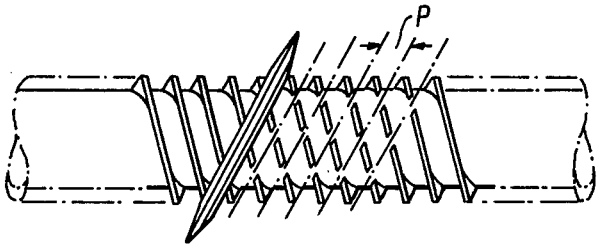
FIG. 5 is an explanatory view, showing a heat transfer pipe embodying the invention.

Pipe blanks with outer diameters of 19.09 mm and wall thicknesses of 1.32 mm were externally formed with 19 spiral fins per inch by rolling to provide low fin heat transfer pipes (A). Such low fin heat transfer pipes (A) were formed with breaks having pitch P, shown in FIG. 5, equal to about 8 mm to provide heat transfer pipes (B) of the present invention, and with P equal to about 3 mm to provide heat transfer pipes (C) of the invention. These pipes were compared as to overall heat transfer coefficient U by passing water as a cooling liquid through the pipe and R-22 gas as a refrigerant over the outer surface of the pipe, said refrigerant being allowed to condense.

Figure 6:
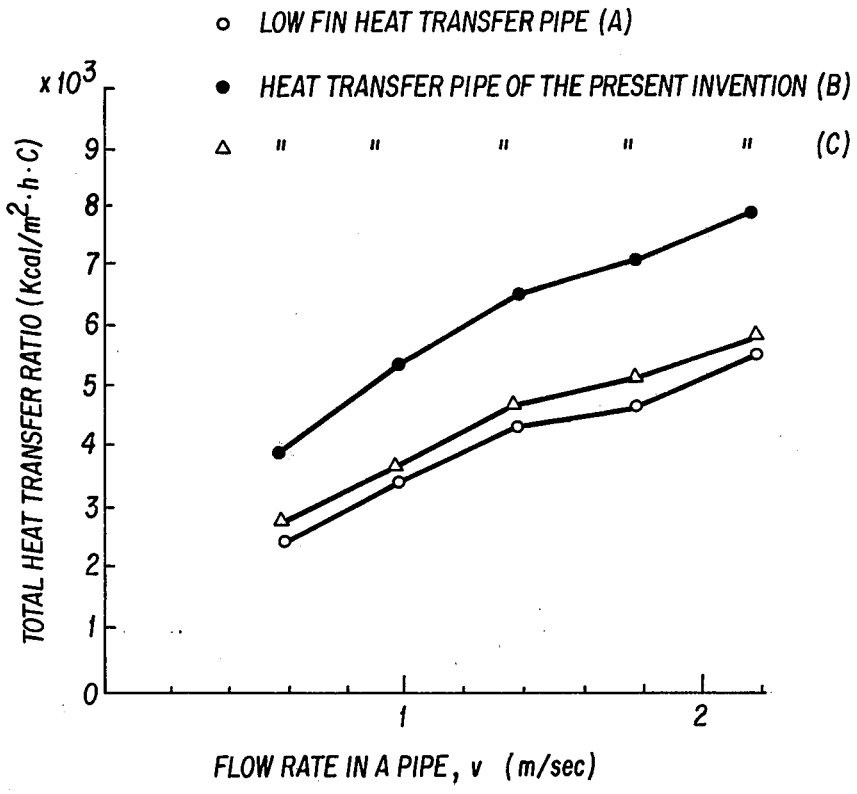
FIGS. 6 through 8 are graphs showing the effects of the invention.
Figure 7:
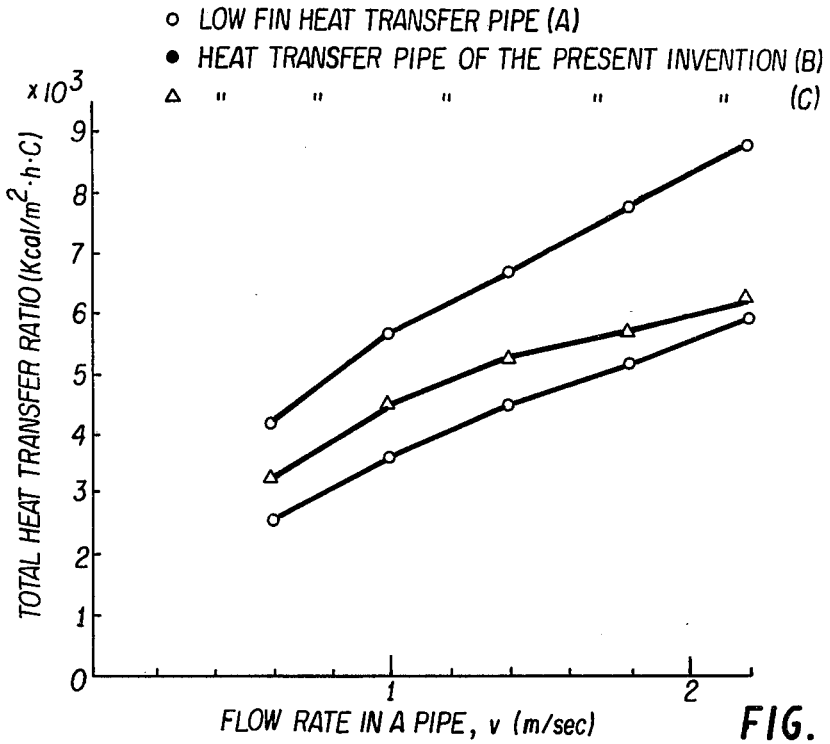
Figure 8:
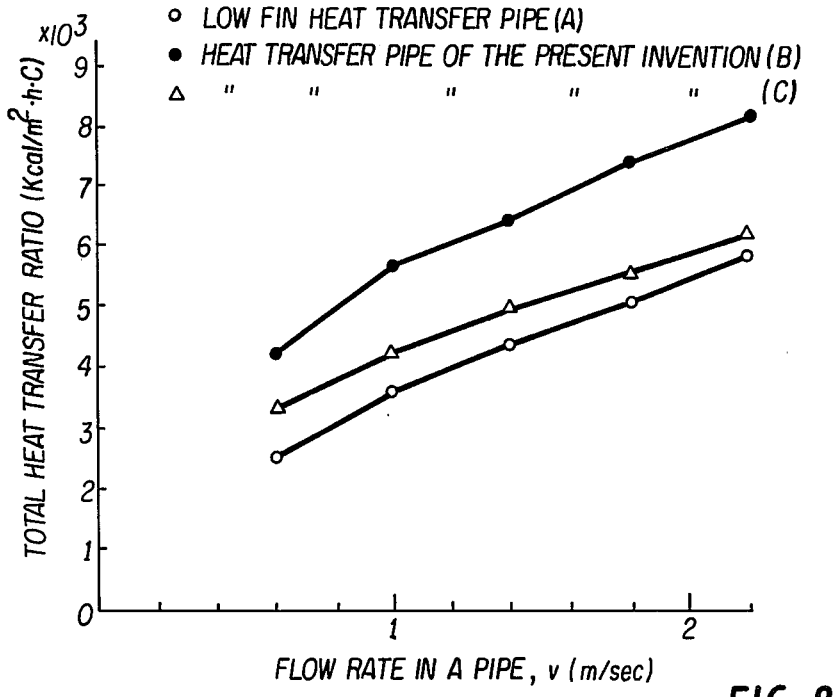

The results are shown in FIGS. 6 through 8. The flow rate of R-22 gas was 46 kg/hr in FIG. 6, 62 kg/hr in FIG. 7 and 77 kg/hr in FIG. 8.

As is clear from FIGS. 6 through 8, the heat transfer pipes (B) and (C) having breaks (and at the same time, beads and waves on the inner surface), particularly the heat transfer pipe (B) having a pitch of 8 mm for the breaks provide greatly increased overall heat transfer coefficients which are more than 50% higher than that of the conventional low fin heat transfer pipe (A).

Obviously, numerous modifications and variations of the present invention are possible in light of the above teachings. It is therefore to be understood that within the scope of the appended claims, the invention may be practided otherwise than as specifically described herein.

What is claimed as new and desired to be secured by Letters Patent of the United States is:

1. A heat transfer wall comprising a heat transfer wall body, a plurality of fins integrally formed on one surface of said body, extending parallel to each other and having breaks formed therein at a predetermined pitch, and a plurality of discrete projecting beads integrally formed on the other surface of said body, wherein said fins, when viewed in a direction perpendicular to a wall surface of the wall body, extend in a direction which crosses imaginary lines connecting said beads, said beads being formed on at least some of the intersections between said fins and said imaginary lines, and wherein said wall body has a wavy surface with said imaginary lines bulging to form raised areas extending in the direction of said imaginary lines, said beads being formed upon said raised areas.

2. The wall of claim 1 wherein said breaks are formed at said at least some of the intersections between said fins and said imaginary lines upon which said beads are formed.

3. A heat transfer pipe comprising a cylindrical heat transfer pipe body, at least one row of spiral fins integrally formed on the outer surface of said body and having breaks formed therein with a predetermined pitch, and a plurality of discrete beads integrally formed on the inner surface of said body along imaginary lines having a lead angle which is in reverse relation to the lead angle of said fins, wherein said beads are formed on at least some of the intersections between said imaginary lines and said spiral fins and said wall body has a wavy surface with said imaginary lines bulging to form raised areas extending in the direction of said imaginary lines, said beads being formed upon said raised areas.

4. The pipe of claim 3 wherein said breaks are formed at said at least some of the intersections between said fins and said imaginary lines upon which said beads are formed.

* * * * *

UNITED STATES PATENT AND TRADEMARK OFFICE

CERTIFICATE OF CORRECTION

PATENT NO. : 4,330,036

DATED : May 18, 1982

INVENTOR(S) : Satoh et al

It is certified that error appears in the above—identified patent and that said Letters Patent is hereby corrected as shown below:

Column 3 line 15 delete "condenstate" and insert --condensate--.

Column 7 line 7 delete "practided" and insert --practiced--.

Signed and Sealed this

*Third* Day of *August 1982*

[SEAL]

*Attest:*

GERALD J. MOSSINGHOFF

*Attesting Officer*

*Commissioner of Patents and Trademarks*